United States Patent [19]

Drader

[11] 4,270,678

[45] Jun. 2, 1981

[54] BREAD CARRIER

[76] Inventor: Clarence H. Drader, Box 18, R.R. #2, South Edmonton, Alberta, Canada, T6C 4E6

[21] Appl. No.: 117,275

[22] Filed: Jan. 31, 1980

[51] Int. Cl.[3] ..... B65D 21/02; B65D 6/18

[52] U.S. Cl. ..... 294/169; 211/126; 211/132; 206/506; 294/172

[58] Field of Search ..... 224/48 R, 48 D; 206/506; 211/126, 132

[56] References Cited

U.S. PATENT DOCUMENTS

| | | | |
|---|---|---|---|
| 2,994,463 | 8/1961 | Drader | 224/48 D |
| 3,124,254 | 3/1964 | Davidson | 211/312 |
| 3,146,891 | 9/1964 | Nawman | 211/126 |
| 3,204,778 | 9/1965 | Nawman | 206/506 |
| 3,219,196 | 11/1965 | Hare | 206/506 |
| 4,163,495 | 8/1979 | Drader | 224/48 R |

*Primary Examiner*—George E. Lowrance
*Attorney, Agent, or Firm*—Max L. Wymore

[57] ABSTRACT

The bread carrier comprises a plastic rectangular tray and a pair of generally U-shaped metal carrying bails pivotally connected across opposite ends of the tray. To accommodate a load, the pivotal connection between the bail and the tray is spaced inwardly from the ends of the tray. The bails have L-shaped leg members, the heel of which protrudes above the side and end walls of the tray when the bails are folded down. Slot means are provided in the floor of the tray to receive the protruding heels of a second carrier stacked therebelow in a folded position.

3 Claims, 6 Drawing Figures

BREAD CARRIER

BACKGROUND OF THE INVENTION

The present invention relates to an improved carrier for bread or the like. More particularly the invention provides a carrier which can be folded in a space saving stacked arrangement.

The prior art bread carriers have been constructed either of metal, as exemplified in U.S. Pat. No. 3,204,778 issued to Nawman et al., or of plastic, as exemplified by U.S. Pat. No. 4,163,495 issued to Drader. The metal carriers enjoy the advantages of rigidity and strength and durability, while the plastic carriers provide these advantages adequately at a lower manufacturing cost.

Bread carriers generally comprise a rectangular tray having a pair of carrying bails pivotally connected in the side walls at oppositely disposed ends of the tray. For space saving purposes, the height of the peripheral walls on the tray is minimized and the bails are designed to be folded flat to permit the empty trays to be stacked one on top of another.

In the abovementioned patent to Nawman, et al., a metal bread carrier is disclosed having a pair of generally U-shaped carrying bails pivotally connected to the tray at pivot points spaced inwardly from the end walls of the tray. The bails have generally L-shaped leg members, the heels of which are nested in the corners of the tray when the bails are in an upright position. When the bails are folded down, the heels of the leg members protrude above the horizontal plane of the floor of the tray but do not protrude above the top edge of the peripheral wall. This latter arrangement was felt to be desirable to make the trays easy to stack.

SUMMARY OF THE INVENTION

In accordance with the present invention, there is provided a bread carrier having metal carrying bails combined with a plastic tray. To prevent the plastic failing at the pivot where the bail legs connect with the tray side walls, due to excessive leverage applied by the bails when they are loaded, these pivot points have been moved inwardly from the end walls of the tray. Thus the horizontal legs of the L-shaped leg members are longer than has been conventional. As a result, the heels of the L-shaped leg members protrude above the top edge of the peripheral walls of the carrier. To accommodate these protruding heels within the depth of the side walls, as taught by the prior art, added an undesirable bulkiness to the carriers. To overcome this problem, slot means have been provided in the floor of each tray; the slot means are adapted to receive the protruding heels of the leg members of a second carrier stacked therebelow in a folded position. Thus a carrier has been provided in which metal bails have been combined with a plastic tray without losing the space-saving advantage of peripheral walls of low height.

Broadly stated, the invention is a carrier for bread and the like comprising: a plastic rectangular tray having floor means, spaced upstanding side walls and spaced upstanding end walls; a pair of metal carrying bails pivotally connected to the side walls and extending along the oppositely disposed end walls, each of the bails being moveable between an upright position and a folded position; each of the bails comprising a pair of spaced generally L-shaped leg members having upper and lower legs, the lower leg of each leg member being pivotally connected to the tray at a point spaced inwardly from the end wall such that the heel of the leg member, when the bail is in the upright position, is nested in a corner of the tray and, when the bail is in the folded position protrudes above the upper edges of the side and end walls, said bail further comprising a horizontal handle member interconnecting the upper legs of the pair of leg members; slot means in the floor means of the tray for receiving the protruding heels of the leg members of a second carrier stacked therebelow in a folded position whereby the peripheral walls of one carrier nest on the peripheral walls of the other; and locking means on the tray for releasably locking the bails in the upright position.

DESCRIPTION OF THE PREFERRED EMBODIMENT

Figure 1:
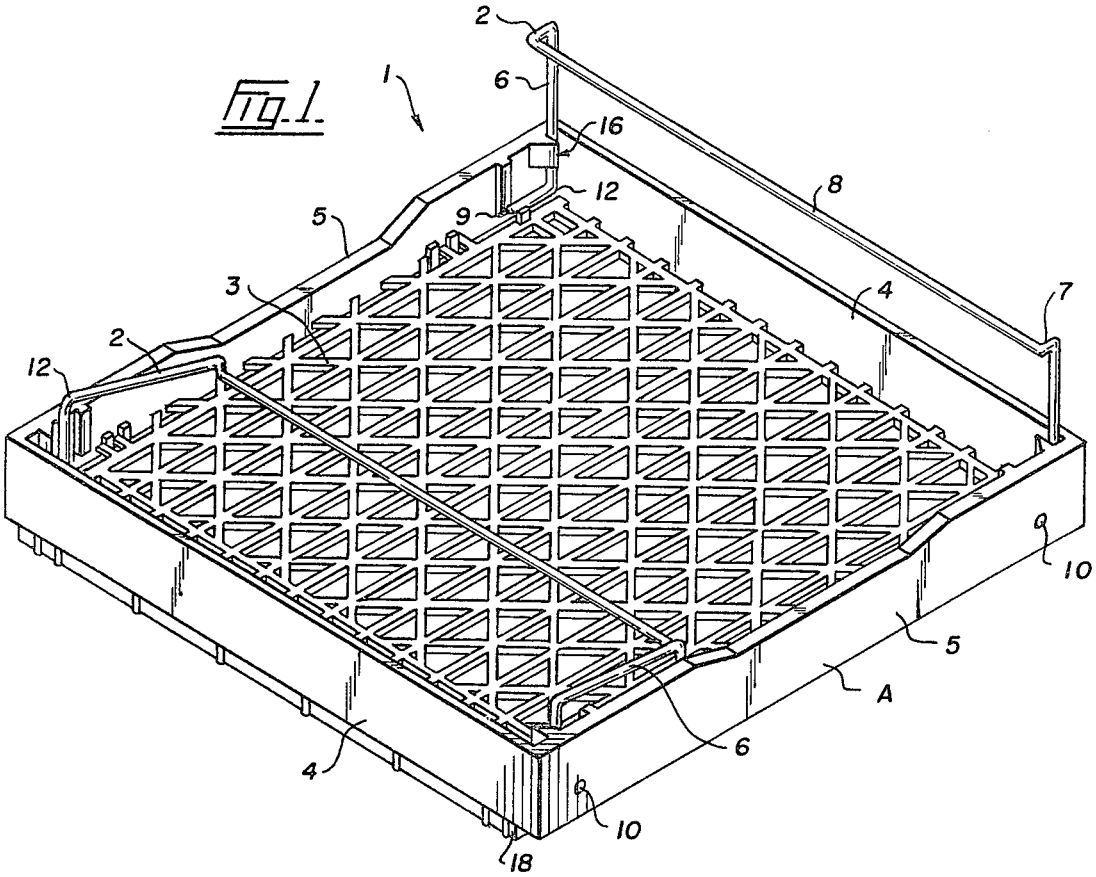
FIG. 1 is a perspective view of the carrier of the present invention showing one bail in the upright position and one in the folded position.

With reference to the drawings, the carrier A of the present invention is shown to include a plastic rectangular tray 1 and a pair of generally U-shaped metal carrying bails 2. The tray 1 includes a webbed floor 3, spaced end walls 4 and side walls 5. The height of the end and side walls 4, 5 is sufficient to give structural stability to the tray and to provide retaining edges for a load of bread or the like. The height of the walls is also minimized from the point of view of space saving.

Each of the bails 2 includes two spaced generally L-shaped leg members 6 having lower and upper legs 9,7. The upper legs 7 are interconnected at their upper ends by a horizontal handle portion 8. The lower legs 9 of the leg members 6 are pivotally connected to the side walls 5 of the tray 1 at pivot points 10. More particularly, the lower legs 9 have outwardly directed horizontal portions 11, which are journalled through the side walls 5 at the pivot points 10 to provide the pivotal connection.

The pivot points 10 are spaced inwardly from the end walls 4 in order to displace the fulcrum point from the load to prevent the plastic tray 1 from tearing or failing at the pivot points 10.

Figure 3:
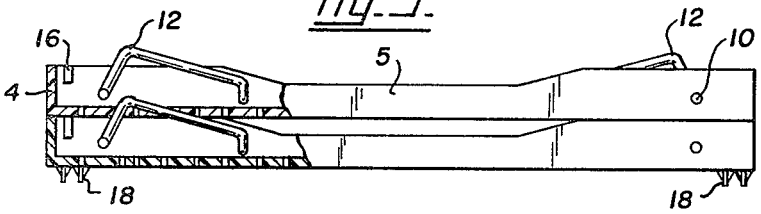
FIG. 3 is a partly fragmentary side view of two carriers in a folded stacked arrangement.
Figure 4:
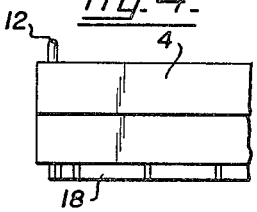
FIG. 4 is a partial end-on view of two carriers in a folded stacked arrangement.
Figure 5:
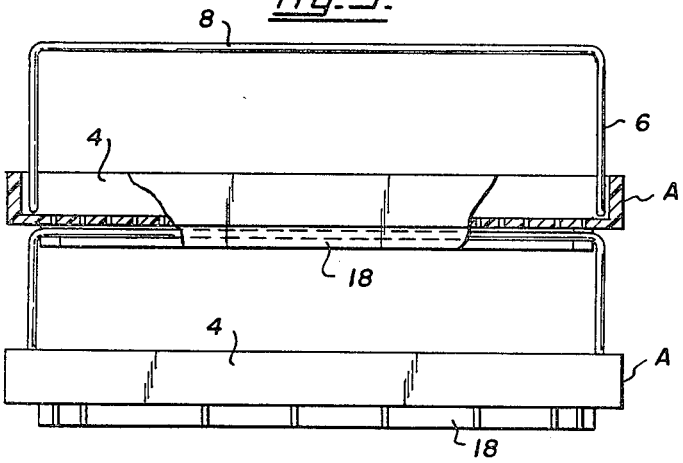
FIG. 5 is a partly fragmentary end-on view of two carriers in an upright stacked arrangement.
Figure 6:
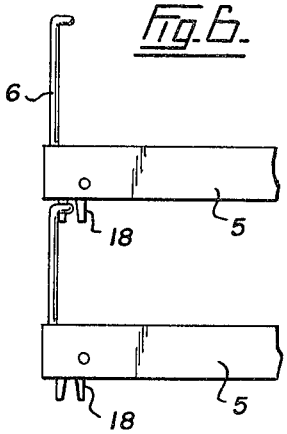
FIG. 6 is a partial side view of two carriers in an upright stacked arrangement.

The bails 2 are moveable between the upright position shown in FIGS. 5 and 6 and the folded position shown in FIGS. 3 and 4. As detailed in FIG. 1, heel 12 of each leg member 6 is nested in the corner 13 of the tray 1 when the bail 2 is upright. In the folded position, as illustrated in FIGS. 1 and 3, the heel 12 protrudes above the upper edge of the side wall 5.

Figure 2:
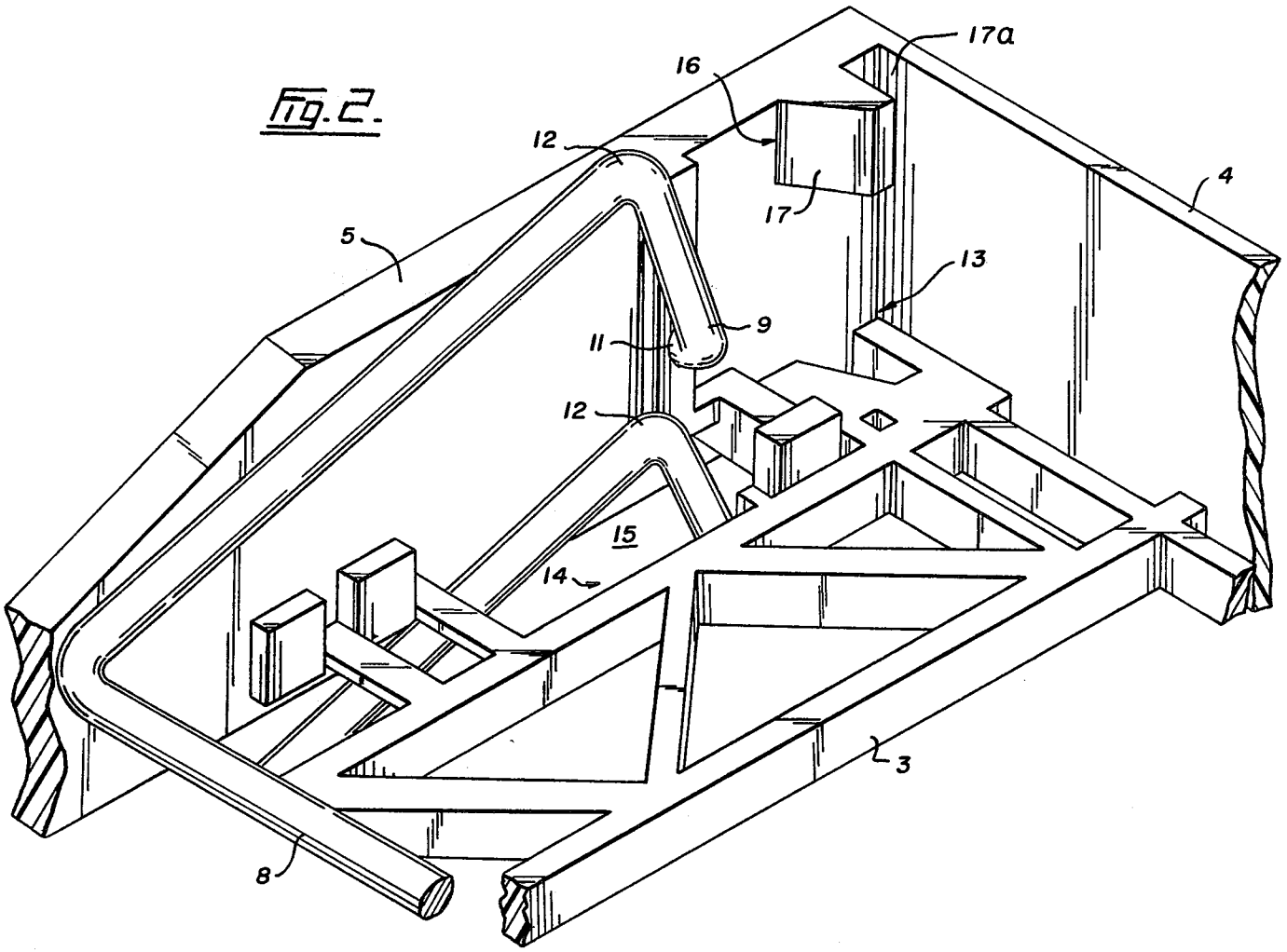
FIG. 2 is an enlarged perspective view of a corner of a first carrier, showing the protruding bail of a second carrier stacked therebelow being accommodated in slot means formed in the floor of the first carrier.

To allow the carriers A to be stacked in the folded position, the protruding heels 12 of each folded bail 2 are accommodated in slot means 14 provided in the floor 3 of the tray 1. These slot means 14, which comprise rectangular slots 15, are spaced inwardly from the end walls 4 of the tray 1, so as to be in receiving relationship with the protruding heel 12 of a folded carrier A stacked therebelow. This relationship is illustrated in FIG. 2.

To hold the bail 2 in the upright position, locking means 16 are provided on the tray 1. One such means 16 is shown as plastic wedges 17 extruded to be integral with the side walls 5 of the tray 1. The wedges 17 are spaced from the end walls 4 to form cavities 17*a*. Being of a plastic material, the wedges 17 yield sufficiently to allow the bails 2 to be moved past them into the cavities 17*a*, whereby the bails 2 are releasably retained in the upright position.

To help retain a stack of carriers in the upright position shown in FIGS. 5 and 6, U-shaped lugs 18 may be provided on the underside of the tray 1. These lugs 18 are positioned so as to straddle the horizontal handle portion 8 of the bail 2 of a second carrier A stacked therebelow. The handle portion 8 is preferably bent inwardly toward the centre of the tray 1 as shown in FIG. 1. Thus the lugs 18, to receive the handle portion 8, are also spaced inwardly from the ends of the tray 1. In this way, the carriers A, when stacked in the folded arrangement, interlock with one another since the lugs 18 of a first carrier are retained inside the end and side walls 4, 5 of a second carrier stacked therebelow.

The following features and advantages arise from the preferred embodiment of the carrier:

1. The advantages afforded by the strong metal carrying bails and the relatively inexpensive plastic tray can be combined by moving the pivot point between the bail and the tray inwardly from the ends of the tray.

2. The protruding heel of the bails, which arises from offsetting the pivot point, is accommodated by slot means in the floor of the tray. Thus the height of the side walls can be minimized to provide a space saving carrier.

3. The protruding heel provides a visible target to facilitate stacking of the folded carriers.

While the present invention has been disclosed in connection with the preferred embodiment thereof, it should be understood that there are other embodiments which fall within the spirit and scope of the invention as defined by the following claims.

The embodiments of the invention in which an exclusive property or privilege is claimed are defined as follows:

1. A carrier for bread and the like comprising:

a plastic rectangular tray having floor means, spaced upstanding side walls and spaced upstanding end walls;

a pair of metal carrying bails pivotally connected to the side walls and extending along the oppositely disposed end walls, each of the bails being moveable between an upright position and a folded position;

each of the bails comprising a pair of spaced generally L-shaped leg members having upper and lower legs, the lower leg of each leg member being pivotally connected to the tray at a point spaced inwardly from the end wall such that the heel of the leg member, when the bail is in the upright position, is nested in a corner of the tray and, when the bail is in the folded position, protrudes above the upper edges of the side and end walls, said bail further comprising a horizontal handle member interconnecting the upper legs of the pair of leg members;

slot means in the floor means of the tray for receiving the upwardly protruding heels of the leg members of a second carrier stacked therebelow in a folded position wherby the peripheral walls of one carrier rest on the peripheral walls of the other; and locking means on the tray for releasably locking the bails in the upright position.

2. The carrier as set forth in claim 1 which further comprises:

a plurality of generally U-shaped lugs protruding downwardly from the underside of the floor means, for engaging the bail of a second carrier stacked therebelow in an upright position to fix the uppermost carrier relative to the carrier below.

3. The carrier as set forth in claim 1 wherein:

the lower leg of each of the L-shaped leg members terminates in an outwardly directed horizontal portion which is journalled through the side wall to pivotally connect the bail to the tray.

* * * * *